US009771204B2

(12) United States Patent
Meether et al.

(10) Patent No.: US 9,771,204 B2
(45) Date of Patent: Sep. 26, 2017

(54) HINGED INSULATED CONTAINER LID

(71) Applicant: The Coleman Company, Inc., Wichita, KS (US)

(72) Inventors: Stuart L. Meether, Wichita, KS (US); Ricky J. Glazier, Cheney, KS (US); Mark Elliott, Park City, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 14/615,878

(22) Filed: Feb. 6, 2015

(65) Prior Publication Data

US 2015/0217926 A1 Aug. 6, 2015

Related U.S. Application Data

(60) Provisional application No. 61/936,410, filed on Feb. 6, 2014.

(51) Int. Cl.

| | |
|---|---|
| ***B65D 43/16*** | (2006.01) |
| ***B65D 81/38*** | (2006.01) |
| *B65D 25/28* | (2006.01) |
| *A45C 11/20* | (2006.01) |
| *A45C 13/00* | (2006.01) |

(52) U.S. Cl.

CPC ..... *B65D 81/3813* (2013.01); *B65D 81/3816* (2013.01); *A45C 11/20* (2013.01); *A45C 13/005* (2013.01); *B65D 25/2835* (2013.01)

(58) Field of Classification Search

CPC ..... B65D 81/3813; B65D 81/3816; B65D 25/2835; B65D 43/161; B65D 2251/1083; B65D 2251/0053

USPC ..... 220/819, 818, 817, 836, 837, 826; 206/349

See application file for complete search history.

(56) References Cited

U.S. PATENT DOCUMENTS

| | | | | |
|---|---|---|---|---|
| 2,347,270 | A * | 4/1944 | Larsson | B25H 3/023 190/30 |
| D180,490 | S | 6/1957 | Lunan | |
| D198,425 | S | 6/1964 | Nupp | |
| 3,640,420 | A | 2/1972 | Carter et al. | |
| 3,747,796 | A | 7/1973 | Kneier et al. | |
| 3,979,007 | A | 9/1976 | Thhornbloom, Jr. | |
| 4,143,695 | A | 3/1979 | Hoehn | |
| D259,760 | S | 7/1981 | Lucas et al. | |
| D267,370 | S | 12/1982 | Cline | |
| D292,057 | S | 9/1987 | Beal | |
| D296,066 | S | 6/1988 | Tarozzi et al. | |

(Continued)

FOREIGN PATENT DOCUMENTS

| | | |
|---|---|---|
| CA | 1089786 | 11/1980 |

OTHER PUBLICATIONS

CA2,881,496, "Office Action", Mar. 15, 2016, 1 page.

*Primary Examiner* — Stephen Castellano
(74) *Attorney, Agent, or Firm* — Husch Blackwell LLP

(57) ABSTRACT

An insulated container that includes a body and a lid assembly is described. The lid assembly may include a two-piece lid (e.g., two lids) connected with at least one linkage. The two lids may be operable to open in concert in response to a user asserting a single force applied on one of the lids. For example, the lid assembly may be configured such that the assertion of an opening force on one of the lids is transferred via the linkage to the other lid so that both lids open at a similar rate.

21 Claims, 5 Drawing Sheets

(56) References Cited

U.S. PATENT DOCUMENTS

| | | | |
|---|---|---|---|
| D307,998 | S | 5/1990 | Costello et al. |
| D316,178 | S | 4/1991 | Uemura |
| 5,064,088 | A | 11/1991 | Steffes |
| D324,154 | S | 2/1992 | Embree |
| D325,493 | S | 4/1992 | Hicks et al. |
| D333,386 | S | 2/1993 | Kahl |
| 5,263,338 | A | 11/1993 | Banks |
| D349,628 | S | 8/1994 | Kahl et al. |
| 5,337,911 | A | 8/1994 | Holub |
| D359,658 | S | 6/1995 | Cook |
| 5,524,761 | A | 6/1996 | Wayman |
| 5,975,345 | A | 11/1999 | Taylor |
| 6,334,542 | B1 | 1/2002 | Hsu |
| 7,063,225 | B2 | 6/2006 | Fukuo |
| D525,084 | S | 7/2006 | Willis |
| D548,489 | S | 8/2007 | Cohen |
| 8,066,143 | B2 | 11/2011 | Baltz et al. |
| 8,161,769 | B2 | 4/2012 | Lauchnor |
| 8,256,242 | B1 | 9/2012 | Evans |
| 8,286,828 | B2 | 10/2012 | Schafer |
| 8,356,723 | B2 | 1/2013 | Clement et al. |
| 2005/0218150 | A1 | 10/2005 | Cadiente |

* cited by examiner

HINGED INSULATED CONTAINER LID

CROSS-REFERENCES TO RELATED APPLICATIONS

This application is a Non-Provisional Application of U.S. Provisional Application No. 61/936,410, filed Feb. 6, 2014, the content of which is incorporated herein by reference in its entirety.

BACKGROUND OF THE INVENTION

A portable cooler typically includes an insulated body including an open interior space in which ice and one or more articles that are to be cooled are stored. An insulated lid is also typically provided with the portable cooler. The insulated lid can be attached to the insulated body via a hinge or can be separable from the insulated body.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In some examples, an insulated container includes an insulated body and a lid assembly. The body may include one or more features that form a cavity with a top opening. The one or more features may include, for example, a bottom, a front wall, a back wall, a first side wall, and a second side wall. The lid assembly may include a first lid having a first end panel and a first top panel, a second lid having a second end panel and a second top panel. The first lid may be pivotably attached to the body at a first pivot axis between a first position and a second position. The second lid may be pivotably attached to the body at a second pivot axis between a third position and a fourth position. The insulated container may also include a first linkage pivotably attached to the first end panel of the first lid at a first location and pivotably attached to the second end panel of the second lid at a second location. The first linkage may cause the first lid to pivot about the first pivot axis and the second lid to pivot about the second pivot axis in response to an opening force being applied to at least one of the first lid or the second lid. In some examples, the first linkage includes a cam follower and a slot.

For a fuller understanding of the nature and advantages of the present invention, reference should be made to the ensuing detailed description and accompanying drawings.

BRIEF DESCRIPTION OF THE DRAWINGS

These and other features, embodiments, and advantages of the present disclosure are better understood when the following Detailed Description is read with reference to the accompanying drawings.

DETAILED DESCRIPTION OF THE INVENTION

In the following description, various embodiments of the present disclosure will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments of the present disclosure are directed to, among other things, an insulated container that includes a body and a lid assembly. As described in detail herein, the lid assembly may include a two-piece lid (e.g., two lids) connected with at least one linkage. The two lids may be operable, due to the linkage, to open in concert in response to a user asserting a single force on one of the lids. For example, the lid assembly may be configured such that the assertion of an opening force on one of the lids is transferred via the linkage to the other lid so that both lids open in concert. In this manner, the user may open the lid assembly and access an interior cavity of the body using a single hand asserting a single force. In some examples, opening the lid assembly, including two lids, may be equally as easy as opening an insulated container having a single lid.

Figure 1:
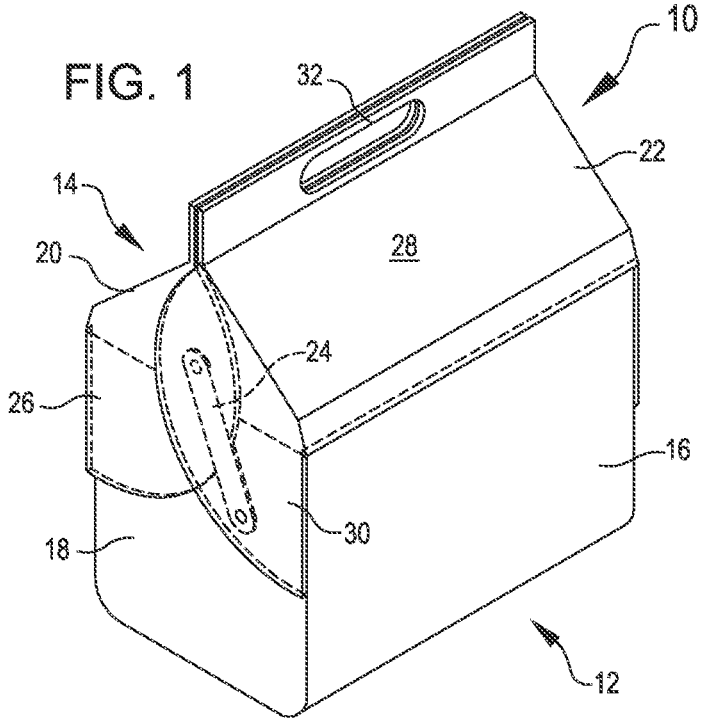
FIG. 1 illustrates a perspective view of an insulated container as described herein, in accordance with at least one example.

Referring now to the drawings, in which like reference numerals represent like parts throughout the several views, FIG. 1 shows an insulated container 10 according to at least one example. The insulated container 10 includes a body 12 and a lid assembly 14. The body 12 includes a bottom (not illustrated), a front wall 16, and a back wall (not illustrated), a first side wall 18, and a second side wall (not illustrated) that form a cavity having an opening. In some examples, at least some of the walls and the bottom of the body 12 are insulated. Thus, the body 12 of the insulated container 10 may be characterized as a cooler, an ice chest, or as any other suitable insulated storage device. The body 12 may be constructed using any suitable materials, for example, plastic (e.g., polypropylene, high-density polyethylene, and any other suitable plastic), metal (e.g., aluminum, stainless steel, steel, and any other suitable metal), wood, composite materials, carbon fiber reinforced materials, and any other suitable material. In some examples, the body 12 is constructed using one or more layers including, for example, any of the previously-listed items, foam, vacuum, or other suitable materials or configurations. For example, the body 12 may include a foam membrane disposed between a plastic interior portion and a plastic exterior portion.

The body 12 may be configured to receive food articles, drink articles, ice, and any other article meant to be kept cold. The articles stored in the body 12 may be accessed via the opening by operating the lid assembly 14. As illustrated, the body 12 may have a generally rectangular shape. In some examples, the body 12 is configured to have a generally square shape or any other suitable shape. In some examples, the body 12 or the lid assembly 14 may be outfitted with a latch and locking mechanism to secure contents of the insulated container 10.

The lid assembly 14 includes at least two lids (e.g., a first lid 20 and a second lid 22) and a first linkage 24 pivotably attached to each of the lids 20, 22. Each of the lids 20, 22 can be constructed using blow molding techniques, injection molding techniques, or any other suitable construction technique. In some examples, the lids 20, 22 may be constructed using any suitable materials, for example, plastic (e.g., polypropylene, high-density polyethylene, and any other suitable plastic), metal (e.g., aluminum, stainless steel, steel, and any other suitable metal), wood, composite materials, carbon fiber reinforced materials, and any other suitable material. In some examples, the lids 20, 22 are constructed using one or more layers including, for example, any of the previously-listed items, foam, vacuum, or other suitable materials or configurations. For example, the lids 20, 22 may include a foam membrane disposed between plastic interiors and plastic exteriors.

The lids 20, 22 may be configured to form a contact seal with a top surface of the body 12. To this end, the two lids 20, 22, when closed, cover the opening in the body 12, with each lid extending over half of the body 12. The two lids extend the length of the body, and are positioned on opposite sides of the opening in the body. Each of the lids 20, 22 may be defined as having a top panel and at least two side panels, firming generally a U-shape, with the top panel forming the center and the two side panels forming the legs of the U. The U shape is turned upside down to fit over and around the top of the body 12. While the lids 20, 22 may be defined as having multiple panels, it is understood that the lids 20, 22 may each be constructed as one piece. Regarding the second lid 22, the second lid 22 includes a second top panel 28, a second end panel 30, and an opposing second end panel (not illustrated). Similarly, the first lid 20 includes a first top panel (not illustrated), a first end panel 26, and an opposing first end panel (not illustrated). In some examples, a portion of the first end panel 26 and a portion of the second end panel 30 overlap a portion of the first side wall 18.

The first lid 20 and the second lid 22 may be constructed and configured such that a portion of the second end panel 30 overlaps a portion of the first end panel 26 and such that a portion of the second opposing end panel overlaps a portion of first opposing end panel. In this example, both end panels of the first lid 20 are nearer the body 12 of the insulated container 10 than both end panels of the second lid 22. In some examples, one of the end panels of the first lid 20 is nearer the body 12 of the insulated container 10 than one of the end panels of the second lid 22. Thus, in some examples, the overall width of one of the lids may be greater than the other such that the larger lid couples around both end panels of the smaller lid. In some examples, the widths of both lids may be similar such that the lids are end panels that are offset from each when attached to the body. In this example, at least a portion of a first end panel may be covered by at least a portion of a second end panel and at least a portion of an opposing second end panel may be covered by at least a portion of a first opposing end panel.

The first top panel of the first lid 20 may be configured to releasably couple with the second top panel 28 of the second lid 22. When the two halves of the lid assembly 14 (e.g., the first lid 20 and the second lid 22) are in a closed position (as illustrated in FIG. 1), the lid assembly 14 provides a hollow cavity between the top of the lids 20, 22 and the top surface of the body 12. In this manner, the insulated container 10 has extra capacity compared to configurations of the insulated container 10 where the lids 20, 22 are flat. The lid assembly 14 also includes a handle 32. As illustrated, the handle 32 may be integrated into the first lid 20 and the second lid 22. In some examples, the handle 32 is integrated or attached to the body 12. For example, the lid 22 may have a U-shape and connect to the first side wall 18, extend above the lid assembly 14, and connect to the second side wall.

Figure 2:
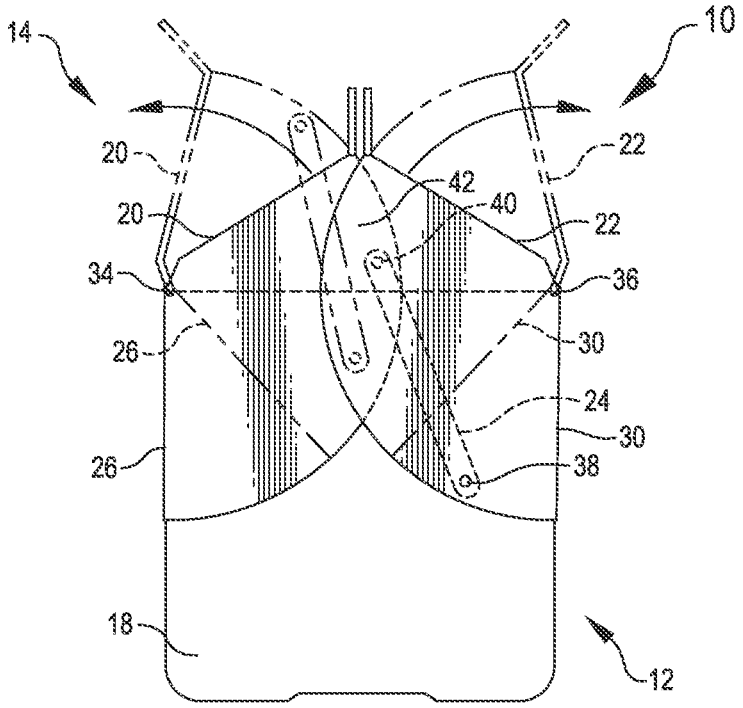
FIG. 2 illustrates a side view of an insulated container and movement of a lid assembly of the insulated container as described herein, in accordance with at least one example.

In FIG. 2 is illustrated a side view of the insulated container 10, according to at least one example. In FIG. 2, rotational paths for the first lid 20 and the second lid 22 are illustrated. The rotational paths are represented as the first lid 20 and the second lid 22 (both illustrated with unbroken lines in a closed position) are moved to a partially open position illustrated with phantom lines. In order to rotate along the rotational paths, the first lid 20 is pivotably attached to the body 12 via a first hinging pivot axis 34. Similarly, the second lid 22 is pivotably attached to the body 12 via a second hinging pivot axis 36. In some examples, the hinging pivot axes 34, 36 are configured to allow the first lid 20 and the second lid 22 to rotate about the hinging pivot axes 34, 36. The hinging pivot axes 34, 36 may be constructed of any suitable material or combinations of materials capable of allowing rotation. For example, the hinging pivot axes 34, 36 may be constructed of plastic or metal and each may be characterized as a barrel hinge, a pivot hinge, a strap hinge, a formed hinge, or any other combinations of mechanisms suitable to enable rotation. Thus, the hinging pivot axes 34, 36 may be any conventional hinging mechanism.

As illustrated in FIG. 2, the first linkage 24 includes a first pin 40 and a second pin 38. The first pin 40 is configured to pivotably attach the first end panel 26 to the first linkage 24. Similarly, the second pin 38 is configured to pivotably attach the second end panel 30 to the first linkage 24. In some examples, the first linkage 24 is configured to rotate about the pins 40, 38 as the lids 20, 22 move from a first position (e.g., closed) to a second position (e.g., open). In some examples, the first pin 40 is offset and upward from the second pin 38 when the lid assembly 14 is in the closed position. The relationship between the attachment locations of the pins 40, 38, the length of the first linkage 24, and the location of hinging pivot axes 34, 36 may determine whether the first lid 20 and the second lid 22 open uniformly. Depending on the configuration of the first lid 20 and the second lid 22, the first linkage 24 may be disposed between the first lid 20 and the second lid 22, with the second lid 22 covering a portion of the first linkage 24, or the first linkage 24 may be disposed between the first lid 20 and the second lid 22, with the first lid 20 covering a portion of the first linkage 24. Because the first linkage 24 is pivotably attached to the first lid 20 and the second lid 22, when a user attempts to open the lid assembly 14 by pulling on the first lid 20 (e.g., by applying an opening force on the first lid 20 in a direction away from the opening of the body 12), the energy from the opening force will be transferred through the first linkage 24 and applied to the second lid 22. A similar, but opposite, transfer of force will take place when the user attempts to open the lid assembly 14 by pulling on the second lid 22. In this manner, both of the lids 20, 22 of the insulated container 10 may be opened easily, efficiently, and automatically by using one hand (e.g., applying a single opening force to one of the lids 20, 22). The displacement of the first linkage 24 is shown as it moves between the two positions illustrated in FIG. 2.

In some examples, because of the length of the first linkage 24, the geometry of the first lid 20 and the second lid 22, and the placement of the first pin 40 and second pin 38, the opening force will cause the lids 20, 22 to open at a similar rate and following similar complimentary curves. To provide this function, the pins 40, 38 are spaced equally from the respective rotational axes (i.e., the first hinging pivot axis 34 and the second hinging pivot axis 36) of the pins' respective lids (i.e., the first lid 20 and the second lid 22). In addition, the overall length of the first linkage 24 may control how far the lids 20, 22 are able to open. Thus, in some examples, the first linkage 24 may act as a stop to keep the lids 20, 22 from over-opening. In some examples, over-opening is controlled or mitigated at the pivot axes, 34, 36. For example, the pivot axes 34, 36 may be constructed in a manner that only allows a certain range of rotation. In some examples, stops may be included in the pivot axes 34, 36 or otherwise to limit movement of the lids.

In some examples, the lid assembly 14 also includes a second linkage that is similarly constructed as the first linkage 24, but that is mounted opposite the first linkage 24 adjacent the second end wall. In any event, the first linkage 24 and/or the second linkage may be configured to control the operation of the first lid 20 and the second lid 22. In some examples, the size of the components of the lid assembly 14 can be sized to accommodate any suitably-sized insulated container. In some examples, the first linkage 24 may be constructed using blow molding techniques, injection molding techniques, or any other suitable construction technique. The first linkage 24 may be constructed of any suitable rigid or semi-rigid material. In some examples, the first linkage 24 is constructed of plastic (e.g., polypropylene, high-density polyethylene, and any other suitable plastic), metal (e.g., aluminum, stainless steel, steel, and any other suitable metal), wood, composite materials, carbon fiber reinforced materials, and any other suitable rigid or semi-rigid material.

Figure 3:
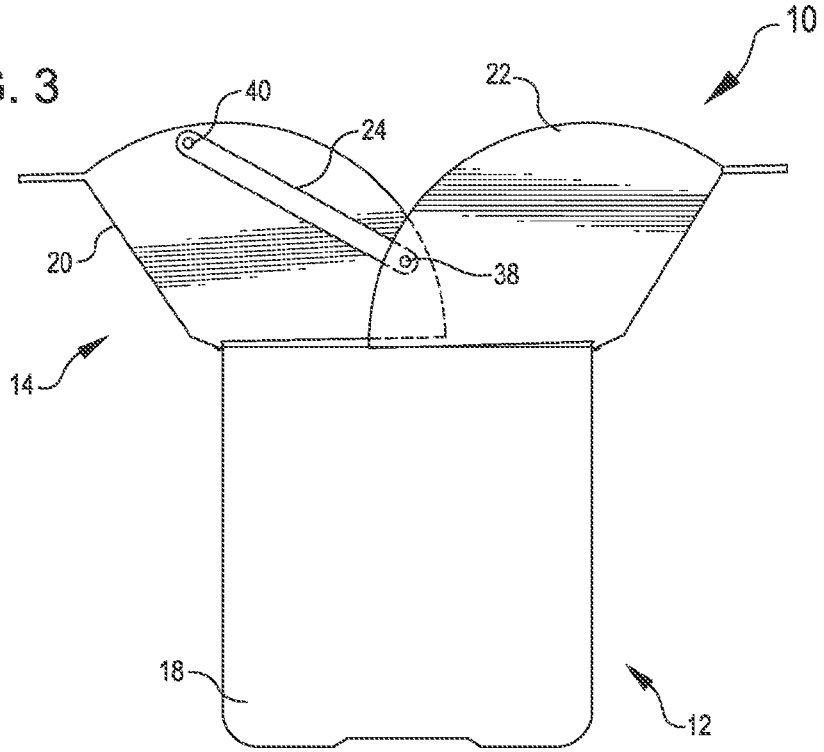
FIG. 3 illustrates a side view of an insulated container and a lid assembly of the insulated container in an open position as described herein, in accordance with at least one example.

In FIG. 3 is illustrated the insulated container 10 with the lid assembly 14 in a maximum open position, according to at least one example. In some examples, the extent to which the lid assembly 14 may be opened depends on the placement of the first linkage 24 and the arrangement of the first hinging pivot axis 34 and the second hinging pivot axis 36. In some examples, the first lid 20 and the second lid 22 rotate about their respective hinging pivot axes 34, 36 through angles greater than 90 degrees. This may enable the lids 20, 22 to open sufficiently wide for efficient access by a user of articles stowed within the body 12.

Figure 4:
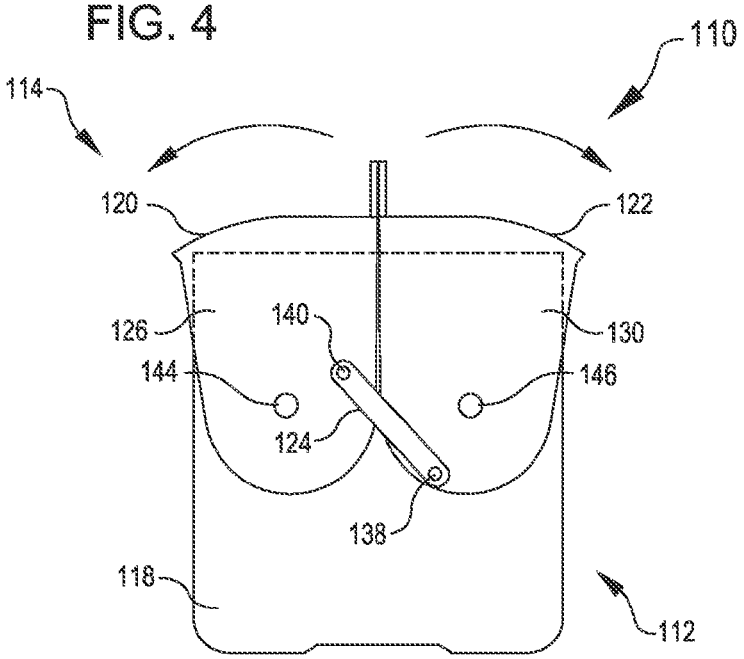
FIG. 4 illustrates a side view of an insulated container and a lid assembly of the insulated container in a closed position as described herein, in accordance with at least one example.

In FIG. 4 is illustrated an insulated container 110 with a lid assembly 114 in a closed position, according to at least one example. In the illustrated example, a first lid 120 and a second lid 122 have a slightly different shape than in the lids 20, 22 discussed with reference to FIGS. 1-3. Thus, in some examples, the first lid 120 and the second lid 122 may constructed to have hug closely to the top surface of the opening of the of a body 112 as the lids 120, 122 move from open to closed. In this manner, the first lid 120 and the second lid 122 may take up less space than some other examples discussed herein. The first lid 120 and the second lid 122 may be configured to contact the top surface of the opening of the body 112 in a manner that creates a seal between the lids 120, 122 and the body 112.

A first end panel 126 of the first lid 120 is pivotably attached to a first side wall 118 via a first pin pivot axis 144. A second end panel 130 of the second lid 122 is pivotably attached to a first side wall 118 via a second pin pivot axis 146. Similar, but opposing pin pivot axes may be provided on the second side wall that opposes the first side wall 118. In this example, the first end panel 126 and the second end panel 130 lie in roughly the same plane that runs parallel to the first side wall 118. Thus, both the first end panel 126 and the second end panel 130 may be disposed adjacent the first side wall 118. In some examples, the first end panel 126 may be connected to the second end panel 130 via a first linkage 124. The first linkage 124 may be disposed adjacent outside surfaces of the first end panel 126 and the second end panel 130. Thus, the first linkage 124 may lie in its own plane that is different than the plane associated with the first end panel 126 and the second end panel 130. Similar to other examples described herein, operation of the lid assembly 114 of the insulated container 110 depicted in FIG. 4 may be performed by a single force (e.g., using only one hand) applied to one of the first lid 120 or the second lid 122. In response to the single force applied to the first lid 120, the second lid 122 is opened automatically because the energy from the force is transferred from the first lid 120 via the first linkage 124 to the second lid 122.

Figure 5:
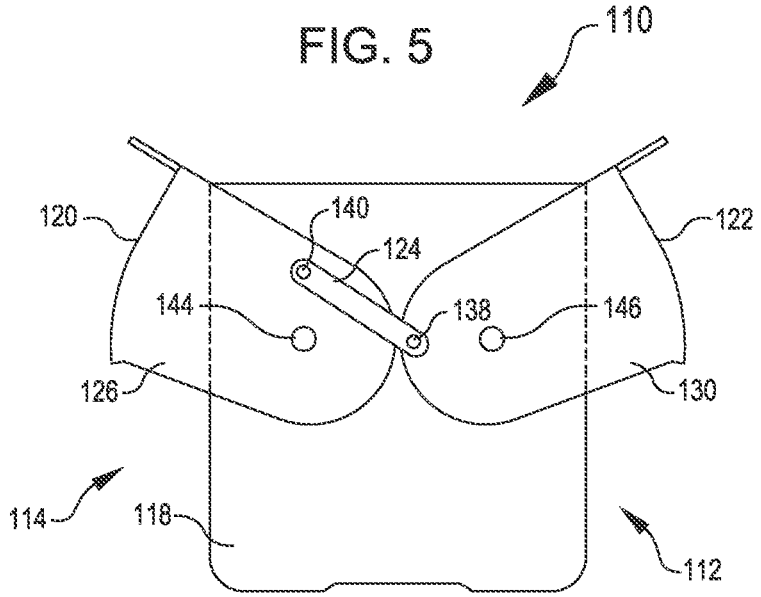
FIG. 5 illustrates a side view of an insulated container and a lid assembly of the insulated container in an open position as described herein, in accordance with at least one example.

In FIG. 5 is illustrated the insulated container 110 with the lid assembly 114 in an open position, according to at least one example. In some examples, the lid assembly 114 may be configured to open even wider than is illustrated in FIG. 5. In any event, the lid assembly 114 may open wide enough to allow unobstructed access to the opening of the body 112. In some examples, the first lid 120 rotates about the first pin pivot axis 144 and the second lid 122 rotates about the second pin pivot axis 146 at a similar rate and following similar complimentary curves. In this example, because the first pin pivot axis 144 and the second pin pivot axis 146 are located closer to the center of the body 112, the complimentary curves lay close to the outside surface of the body 112. This enables the insulated container 110 described in this example to operate in a compact area. In some examples, a first pin 140 is offset and upward from a second pin 138 when the lid assembly 114 is in the closed position. The relationship between the attachment locations of the pins 140, 138, the length of the first linkage 124, and the location of pin pivot axes 144, 146 may determine whether the first lid 120 and the second lid 122 open uniformly. For example, because of the length of the first linkage 124, the geometry of the first lid 120 and the second lid 122, and the placement of the first pin 140 and second pin 138, the opening force will cause the lids 120, 122 to open at a similar rate and following similar complimentary curves. To provide this function, the pins 140, 138 are spaced equally from the respective rotational axes (i.e., the first pin pivot axis 144 and the second pin pivot axis 146) of the pins' respective lids (i.e., the first lid 120 and the second lid 122). In addition, the overall length of the first linkage 124 may control how far the lids 120, 122 are able to open. Thus, in some examples, the first linkage 124 may act as a stop to keep the lids 120, 122 from over-opening. In some examples, over-opening is controlled or mitigated at the pivot axes, 134, 136. For example, the pivot axes 134, 136 may be constructed in a manner that only allows a certain range of rotation. In some examples, stops may be included in the pivot axes 134, 136 or otherwise to limit rotation of the lids.

Figure 6:
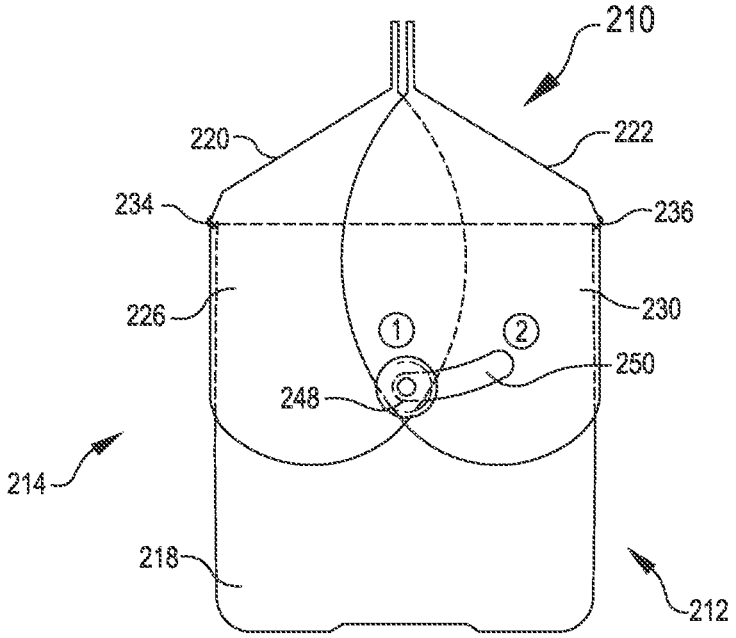
FIG. 6 illustrates a side view of an insulated container and a lid assembly of the insulated container in a closed position as described herein, in accordance with at least one example.

In FIG. 6 is illustrated an insulated container 210 with a lid assembly 214 in a closed position, according to at least one example. In the illustrated example, a first lid 220 and a second lid 222 have a similar shape as the lids 20, 22 discussed with reference to FIGS. 1-3. However, in this example, the linkage between the first lid 220 and the second lid 222 is different. In this example, a cam follower 248 is attached to a first end panel 226 of the first lid 220. The cam follower 248 extends away from a first end panel 226 and through a slot 250 in the second end panel 230 of the second lid 222. In some examples, an opposing cam follower and an opposing slot may be disposed adjacent the second side wall. In any event, the slot 250 may be sized to receive at least a portion of the cam follower 248. In some examples, the slot 250 may have a flat, an arcuate, or a curved design. In some examples, the slot 250 may be considered to have a concave-up shape when the lid assembly 214 is in a closed position. In some examples, the length of the slot 250 and its shape may affect how the first lid 220 and the second lid 222 open in response to an opening force. The cam follower 248 may be configured to move within the slot 250 as the opening force is applied to either of the first lid 220 or the second lid 222. The cam follower 248 is illustrated within the slot 250 at position 1 when the lid assembly 214 is in a closed position. However, as described herein, the cam follower 248 may be configured to move toward position 2 as the opening force is applied to one of the first lid 220 or the second lid 222.

In some examples, the cam follower 248 may be a stud style follower or a yoke style follower. Thus, the cam follower 248 may, in some examples, include a stud, an anti-friction element (e.g., a bearing, a bushing, a roller, or any other suitable anti-friction element), and an outer race having a cylindrical or crowned shape. In some examples, the cam follower 248 is constructed using a stud and a simple structure to retain the stud in the slot 250. For example, in operation the cam follower 248 may include a stud fixedly attached to the first end panel 226 and extending through the slot 250. On the external end of the stud (i.e., the end that extends through the slot 250) may be attached a washer and nut combination, a pin, a clip, or any other structure capable of retaining the second end panel 230.

The relationship between the location of the cam follower 248, the length of the slot 250, and the location of pivot axes 234, 236 may determine whether the first lid 220 and the second lid 222 open uniformly. For example, because of the length of the slot 250, the geometry of the first lid 220 and the second lid 222, and the placement of the cam follower 248, the opening force will cause the lids 220, 222 to open at a similar rate and following similar complimentary curves. In addition, the overall length of the slot 250 may control how far the lids 220, 222 are able to open. Thus, in some examples, the slot 250 may act as a stop to keep the lids 220, 222 from over-opening. In some examples, over-opening is controlled or mitigated at the pivot axes, 234, 236. For example, the pivot axes 234, 236 may be constructed in a manner that only allows a certain range of rotation. In some examples, stops may be included in the pivot axes 234, 236 or otherwise.

Figure 7:
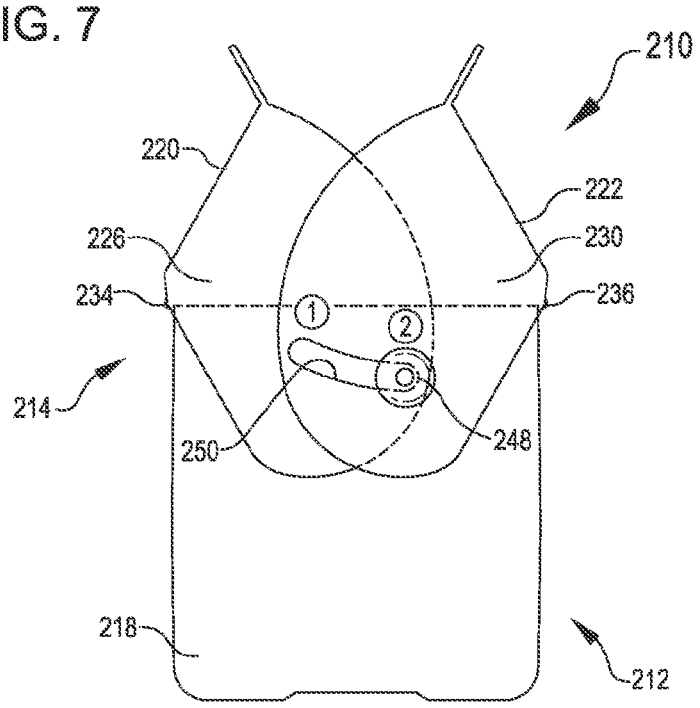
FIG. 7 illustrates a side view of an insulated container and a lid assembly of the insulated container in a partially open position as described herein, in accordance with at least one example.
Figure 8:
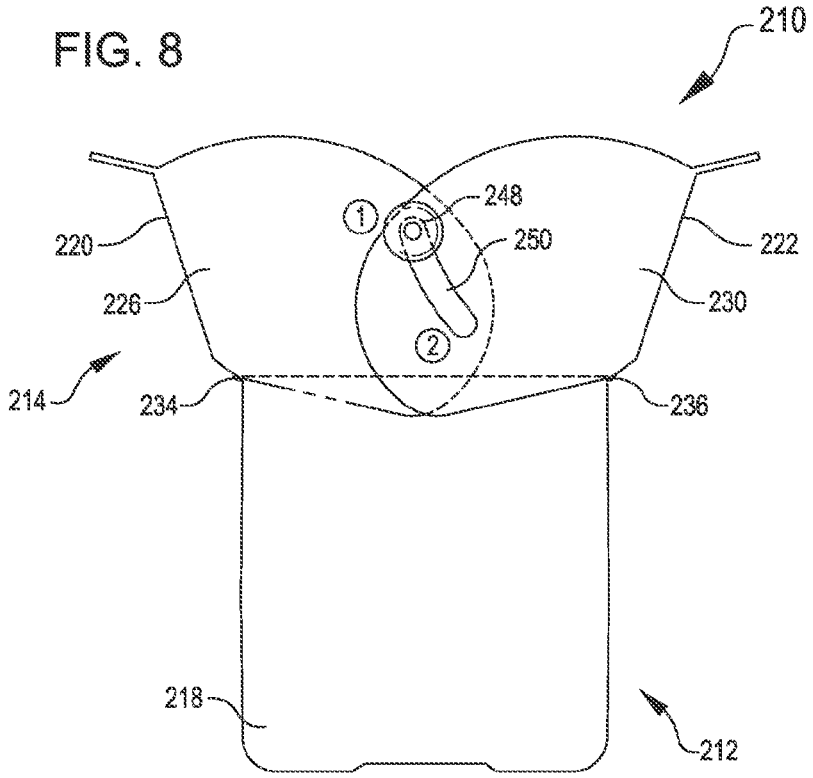
FIG. 8 illustrates a side view of an insulated container and a lid assembly of the insulated container in an open position as described herein, in accordance with at least one example.

In FIG. 7 is illustrated the insulated container 210 with the lid assembly 214 in a partially open position, according to at least one example. In this example, an opening force has been applied to at least one of the first lid 220 or the second lid 222 which has caused the cam follower 248 to move within the slot 250 to position 2. As the opening force is continued to be applied to at least one of the lids 220, 222, the cam follower 248 will move within the slot 250 back to position 1, as illustrated in FIG. 8. In this manner, the movement of the cam follower 248 within the slot 250 transfers the opening force effectively from one of the lids 220, 222 to the other. The location of the cam follower 248 in the slot 250 at the closed position (e.g., in FIG. 6) is the same for the maximum open position (e.g., in FIG. 8).

Figure 9:
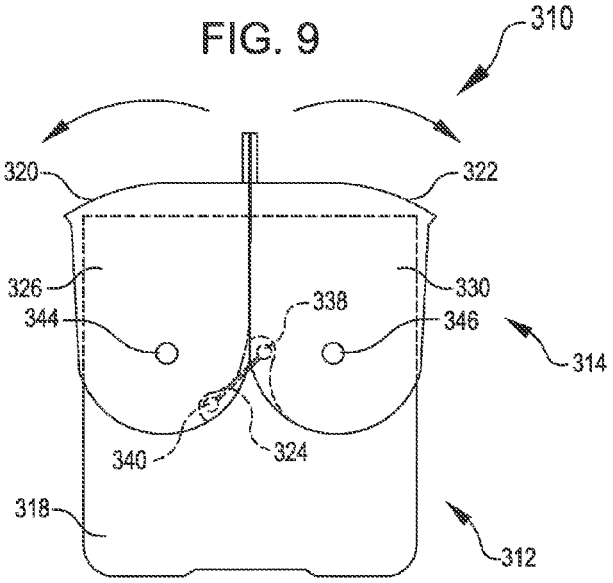
FIG. 9 illustrates a side view of an insulated container and a lid assembly of the insulated container in a closed position as described herein, in accordance with at least one example.
Figure 10:
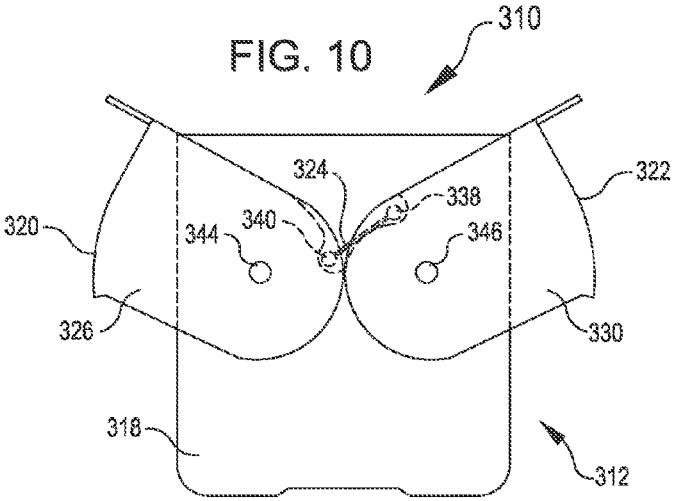
FIG. 10 illustrates a side view of an insulated container and a lid assembly of the insulated container in an open position as described herein, in accordance with at least one example.
Figure 11:
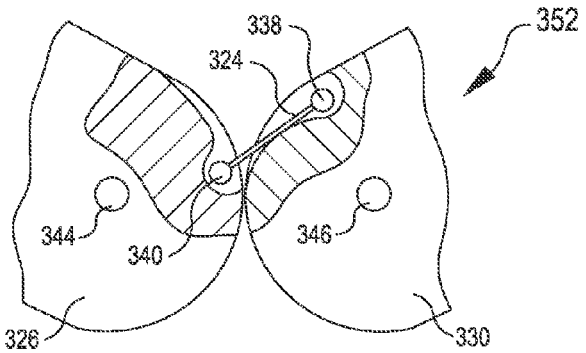
FIG. 11 illustrates a detailed view of a portion of a lid assembly of the insulated container as described herein, in accordance with at least one example.

Turning next to FIGS. 9-11, in which is illustrated an insulated container 310, in accordance with at least one example. In this example, a first lid 320 and a second lid 322 are pivotably attached to a first side wall 318 via a first pin pivot axis 344 and a second pin pivot axis 346, respectively. In this example, the first lid 320 and the second lid 322 are in communication with each other via a flexible linkage 324. The flexible linkage 324 may be constructed of a flexible member such as, for example, a metallic cable, a plastic cable, a non-metallic rope, or any other suitable flexible material capable of withstanding adequate tensile forces. The flexible linkage 324 may be pivotably or fixedly attached to a first end panel 326 via a first pin 340 and to a second end panel 330 via a second pin 338. In some examples, an opposing flexible linkage may be disposed adjacent the second side wall and may be configured similarly to the flexible linkage 324. In some examples, the second pin 338 is offset and upward from the first pin 340 when the lid assembly 314 is in the closed position. The relationship between the attachment locations of the pins 340, 338, the length of the flexible linkage 324, and the location of pin pivot axes 344, 346 may determine whether the first lid 320 and the second lid 322 open uniformly. For example, because of the length of the flexible linkage 324, the geometry of the first lid 320 and the second lid 322, and the placement of the first pin 340 and second pin 338, the opening force will cause the lids 320, 322 to open at a similar rate and following similar complimentary curves. To provide this function, the pins 340, 338 are spaced equally from the respective rotational axes (i.e., the first pin pivot axis 344 and the second pin pivot axis 346) of the pins' respective lids (i.e., the first lid 320 and the second lid 322). In addition, the overall length of the flexible linkage 324 may control how far the lids 320, 322 are able to open. Thus, in some examples, the flexible linkage 324 may act as a stop to keep the lids 320, 322 from over-opening. In some examples, over-opening is controlled or mitigated at the pivot axes, 334, 336. For example, the pivot axes 334, 336 may be constructed in a manner that only allows a certain range of rotation. In some examples, stops may be included in the pivot axes 334, 336 or otherwise.

In some examples, the flexible linkage 324 may be disposed within a portion of the first end panel 326 and a portion of the second end panel 330. For example, as illustrated in FIG. 11, the flexible linkage 324 may be located within the interiors of the first end panel 326 and the second end panel 330. In some examples, the flexible linkage 324 extends through a slit cut in the edge of the first end panel 326. The slit may be sized to accommodate the range of movement of the flexible linkage 324 as the first lid 320 moves from a closed position (e.g., FIG. 9) to an open position (e.g., FIG. 10). A complimentary slit may be included in the second end panel 330. In some examples, only a portion of the flexible linkage 324 may visible to a user at any given time, and the visible portion may change as the first lid 320 and the second lid 322 rotate.

In operation, as a user applies an opening force to the first lid 320, the first lid 320 begins to rotate about the first pin pivot axis 344. This force is then transferred from the first lid 320 via the flexible linkage 324 to the second lid 322, which causes the second lid 322 to begin to rotate about the second pin pivot axis 346. As described herein, the first lid 320 and the second lid 322 may open at a similar rate and following similar complimentary curves. In some examples, the relative lengths of the flexible linkage 324 and the location of the first pin pivot axis 344 and the second pin pivot axis 346 may be maintained to ensure smooth opening.

Combinations of the lid assemblies, the lid constructions, the handles, the linkages, and the bodies other than those explicitly described herein are within the within the spirit and scope of this disclosure. Other variations are also within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An insulated container comprising:

an insulated body having a bottom, a front wall, a back wall, a first side wall, and a second side wall, wherein the bottom, the front wall, the back wall, the first side wall, and the second side wall form a cavity with a top opening; and a lid assembly comprising:

a first lid having a first end panel and a first top panel, the first lid pivotably attached to the insulated body at a first pivot axis, the first lid being pivotable about the first pivot axis between a first position where the first top panel extends over at least a portion of the top opening of the insulated body and the first end panel extends along at least a portion of the first side wall of the insulated body, and a second position where the first top panel is rotated away from extending over the portion of the top opening and the first end panel is rotated upward;

a second lid having a second end panel and a second top panel, the second lid pivotably attached to the insulated body at a second pivot axis, the second lid being pivotable about the second pivot axis between a third position where the second top panel extends over at least the portion of the top opening of the insulated body and the second end panel extends along at least the portion of the first side wall of the insulated body, and a fourth position where the second top panel is rotated away from extending over the portion of the top opening and the second end panel is rotated upward; and a first linkage pivotably attached to the first end panel of the first lid at a first location and pivotably attached to the second end panel of the second lid at a second location, the first location being offset upward from the second location, wherein the first linkage causes the first lid to pivot about the first pivot axis and the second lid to pivot about the second pivot axis in response to an opening force being applied to one of the first lid or the second lid.

2. The insulated container of claim 1, wherein the first lid is pivotably attached to the body at the first pivot axis adjacent the front wall of the insulated body and the second lid is pivotably attached to the insulated body at the second pivot axis adjacent the back wall of the insulated body.

3. The insulated container of claim 2, wherein the first pivot axis and the second pivot axis comprise at least one of a barrel hinge, a pivot hinge, a strap hinge, or a formed hinge.

4. The insulated container of claim 1, wherein the first lid comprises a first opposite end panel and the second lid comprises a second opposite end panel, the first opposite end panel extending along a portion of the second side wall of the insulated body when the first lid is in the first position, the second opposite end panel extending along the portion of the second side wall of the insulated body when the second lid is in the third position.

5. The insulated container of claim 4, further comprising a second linkage pivotably attached to the first opposite end panel of the first lid at a first opposite location and pivotably attached to the second opposite end panel of the second lid at a second opposite location, wherein the second linkage causes the first lid to pivot about the first pivot axis and the second lid to pivot about the second pivot axis in response to the opening force being applied to one of the first lid or the second lid.

6. The insulated container of claim 1, wherein at least a portion of the second end panel overlaps at least a portion of the first end panel.

7. The insulated container of claim 1, wherein the opening force comprises a force asserted in a direction extending away from the top opening of the insulated body, and wherein, in response to the opening force being applied to one of the first lid or the second lid, the first lid pivots about the first pivot axis in accordance with an opening rate and a first opening curvature, and the second lid pivots about the second pivot axis in accordance with the opening rate and a second opening curvature, the first opening curvature opposite the second opening curvature.

8. The insulated container of claim 1, wherein the first linkage comprises:

a first pin pivotably attaching the first end panel and a first end of a rigid strap at the first location; and a second pin pivotably attaching the second end panel and a second end of the rigid strap at the second location.

9. The insulated container of claim 1, wherein the first position corresponds to the first lid being in a closed position and the second position corresponds to the first lid being in an open position.

10. The insulated container of claim 1, wherein the first lid is pivotably attached to the insulated body at the first pivot axis adjacent the first side wall of the insulated body and the second lid is pivotably attached to the insulated body at the second pivot axis adjacent the first side wall of the insulated body.

11. The insulated container of claim 10, wherein the first location is positioned above the first pivot axis and rotates about the first pivot axis in response to the opening force, and wherein the second location is positioned below the second pivot axis and rotates about the second pivot axis in response to the opening force.

12. The insulated container of claim 1, wherein the first lid is pivotably attached to the insulated body at a third pivot axis adjacent the second side wall of the insulated body and the second lid is pivotably attached to the insulated body at a fourth pivot axis adjacent to the second side wall of the insulated body.

13. The insulated container of claim 1, wherein the first pivot axis comprises a first pin that extends from the first side wall through the first end panel of the first lid, and wherein the second pivot axis comprises a second pin that extends from the first side wall through the second end panel of the second lid.

14. The insulated container of claim 1, wherein the first linkage comprises:

a first pin pivotably attaching the first end panel and a first end of a rigid strap at the first location, the rigid strap adjacent a first external surface of the first end panel; and a second pin pivotably attaching the second end panel and a second end of the rigid strap at the second location, the first rigid strap adjacent a second external surface of the second end panel.

15. The insulated container of claim 1, wherein access to the opening is unobstructed by either the first lid or the second lid when the first lid is in the second position and the second lid is in the fourth position.

16. The insulated container of claim 1, wherein the first top panel of the first lid and the second top panel of the second lid form a contact seal with a top surface of the insulated body when the first lid is in the first position and the second lid is in the third position, the top surface of the insulated body defined by respective top surfaces of at least the front wall, the back wall, the first side wall, and the second side wall.

17. The insulated container of claim 1, wherein the first linkage comprises:

a flexible member;

a first pin pivotably attaching the first end panel and a first end of the flexible member at the first location; and a second pin pivotably attaching the second end panel and a second end of the flexible member at the second location, at least a portion of the flexible member inset within a first bottom portion of the first end panel and within a second bottom portion of the second end panel.

18. The insulated container of claim 17, wherein the portion of the flexible member comprises a first portion and a second portion, and wherein the first portion is inset within a first channel extending along the first bottom portion of the first end panel and the second portion is inset within a second channel extending along the second bottom portion of the second end panel.

19. The insulated container of claim 1, wherein the first linkage comprises a first portion and a second portion, the first portion being visible and the second portion being hidden when the first lid is in the first position, the second portion being visible and the first portion being hidden when the first lid is in the second position.

20. The insulated container of claim 1, wherein the first top panel comprises a first handle and the second top panel comprises a second handle.

21. The insulated container of claim 1, wherein the insulated body has a generally rectangular shape.

* * * * *